United States Patent [19]

Kinoshita et al.

[11] Patent Number: 4,485,379

[45] Date of Patent: Nov. 27, 1984

[54] CIRCUIT AND METHOD FOR DRIVING A THIN-FILM EL PANEL

[75] Inventors: Hiroshi Kinoshita, Tenri; Toshihiro Ohba; Masashi Kawaguchi, both of Nara; Yoshiharu Kanatani, Tenri; Hisashi Uede, Wakayama, all of Japan

[73] Assignee: Sharp Kabushiki Kaisha, Osaka, Japan

[21] Appl. No.: 347,421

[22] Filed: Feb. 10, 1982

[30] Foreign Application Priority Data

Feb. 17, 1981 [JP] Japan ..... 56-22644
Feb. 18, 1981 [JP] Japan ..... 56-23312

[51] Int. Cl.[3] ..... G09G 3/30

[52] U.S. Cl. ..... 340/781; 340/805; 340/825.81

[58] Field of Search ..... 340/752, 760, 781, 713, 340/714, 825.81, 766, 805; 315/169.3

[56] References Cited

U.S. PATENT DOCUMENTS 3,975,661 8/1976 Kanatani et al. ..... 340/781
4,152,626 5/1979 Hatta et al. ..... 340/805
4,237,456 12/1980 Kanatani ..... 340/825.81
4,301,451 11/1981 Barta ..... 340/781
4,338,598 7/1982 Ohba et al. ..... 340/781

*Primary Examiner*—Gerald L. Brigance
*Attorney, Agent, or Firm*—Birch, Stewart, Kolasch & Birch

[57] ABSTRACT

An EL panel including an array of scan electrodes, an array of data electrodes crossing the scan electrodes and a plurality of pixels each lying sandwiched between a respective one of the scan electrodes and a respective one of data electrodes is driven by a circuit for applying sequentially a write pulse voltage to the scan electrodes in a line scanning fashion and a circuit for applying a refresh pulse voltage of a polarity opposite to that of the write pulse voltage throughout the panel upon completion of field scanning. The system further includes a circuit for applying throughout the display panel upon completion of field scanning a write compensation pulse of the same polarity as that of the refresh pulse voltage and an amplitude insufficient to cause electroluminescence, and a refresh compensation pulse of a polarity opposite to that of the refresh pulse and an amplitude not enough to cause electroluminescence. Preferably, the values of the write compensation pulse and the refresh compensation pulse depend on factors of an equivalent circuit of the EL panel.

4 Claims, 23 Drawing Figures

T2a T2c T2b $T2 = T2a + T2c + T2b$

T3a T3b $T3 = T3a + T3b$

T4a T4c T4b $T4 = T4a + T4c + T4b$

FIG.10
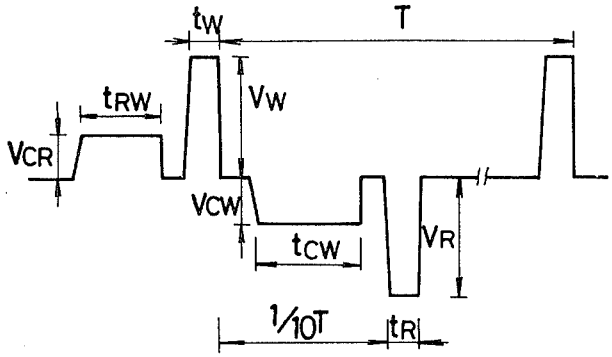
FIG.11 (A)
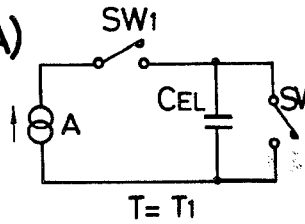
FIG.11 (B)
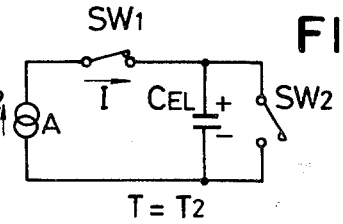
FIG.11 (C)
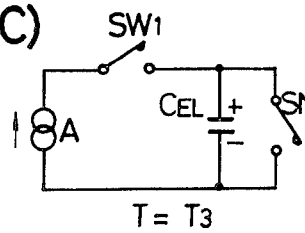
FIG.11(D)
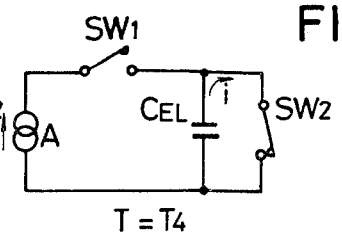
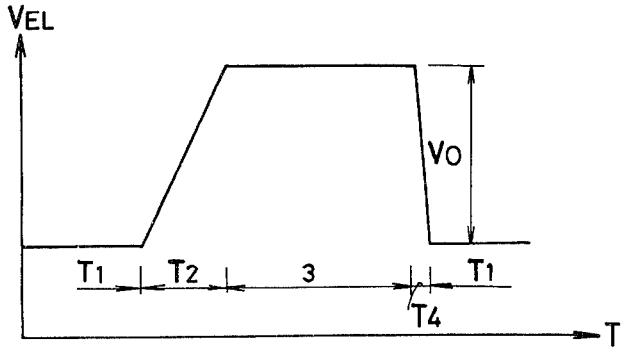
FIG.11(E)

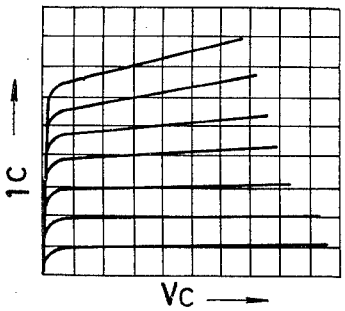
FIG.13(A)
FIG.13(B)
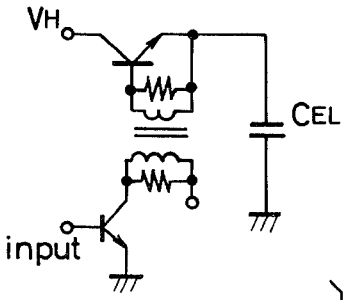
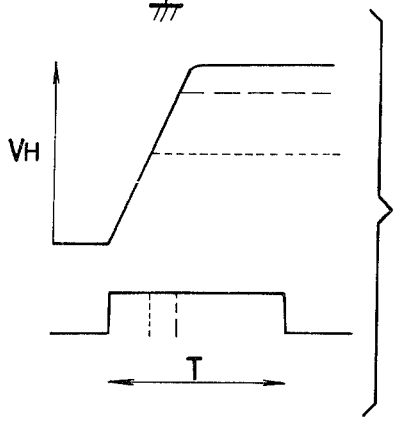
FIG.13(C)

CIRCUIT AND METHOD FOR DRIVING A THIN-FILM EL PANEL

BACKGROUND OF THE INVENTION

This invention relates to a display device of a thin-film three-layered EL structure and more particularly a circuit and method for driving the display device for assuring legibility in a visual display and reliability of long-term operation.

A thin-film EL display panel includes an array of scan electrodes and an array of data electrodes crossing the scan electrodes in a normal direction and a number of EL pixels lying sandwiched between a respective one of the data electrodes and a respective one of the scan electrodes. After scanning is completed throughout the panel while a write pulse $V_W$ is applied sequentially to the scan electrodes in a line scanning fashion, a refresh pulse of an amplitude $V_R$ is applied to complete an alternating cycle of driving. Whether or not the respective pixels on the same scan electrodes are excited is determined by pre-charging of a modulation voltage $V_M$ and especially the pixels desired to be excited are supplied with a write voltage of $V_W+V_M$ and those desired to be non-excited are supplied with a write voltage of $V_W-V_M$. This driving method is suggested by many patents assigned to the assignee of this application including, for example, U.S. Pat. Nos. 3,946,371 to K. Inazaki et al, 3,967,112 to Y. Kanatani et al, 4,024,389 to Y. Kanatani et al, 4,070,663 to Y. Kanatani et al, etc. With those suggested driving methods, a so-called burning phenomenon takes place where a fixed display pattern of figures and characters remains even return to the non-displayed state after the display panel has displayed the fixed display pattern for a substantial period of time.

OBJECT AND SUMMARY OF THE INVENTION

Accordingly, it is an object of the present invention to provide a circuit and a method for driving a thin-film EL display panel which overcomes the above mentioned burning phenomenon.

Briefly described, in accordance with the present invention, a display device comprises an EL panel including an array of scan electrodes, an array of data electrodes crossing the scan electrodes and a plurality of pixels each lying sandwiched between a respective one of the scan electrodes and a respective one of data electrodes, means for applying sequentially a write pulse voltage to the scan electrodes in a line scanning fashion, means for applying a refresh pulse voltage of a polarity opposite to that of the write pulse voltage throughout the panel upon completion of field scanning and, means for applying throughout the display panel upon completion of field scanning a write compensation pulse of the same polarity as that of the refresh to cause electroluminescence, and a refresh compensation pulse of a polarity opposite to that of the refresh pulse but of an amplitude insufficient to cause electroluminescence.

Preferably, the values of the write compensation pulse and the refresh compensation pulse depend on factors of an equivalent circuit of the EL panel.

BRIEF DESCRIPTION OF THE DRAWINGS

For a more complete understanding of the present invention and for further objects and advantages thereof, reference is now made to the following description taken in conjunction with the accompanying drawings, in which:

FIG. 10 is a timing chart containing the compensation pulse according to the present invention;

FIGS. 11(A) to 11(E) are a description of a case where the compensation pulse is applied with a constant current circuit;

FIGS. 13(A) through 13(C) are a description of the constant current switch.

DETAILED DESCRIPTION OF THE INVENTION

As noted previously, the inventors seek an effective measure by which to overcome the burning phenomenon of the thin-film EL panel. The results of the inventor' measurements of the pixels in which the burning phenomenon took place reveal the following aspects.

Figure 1:
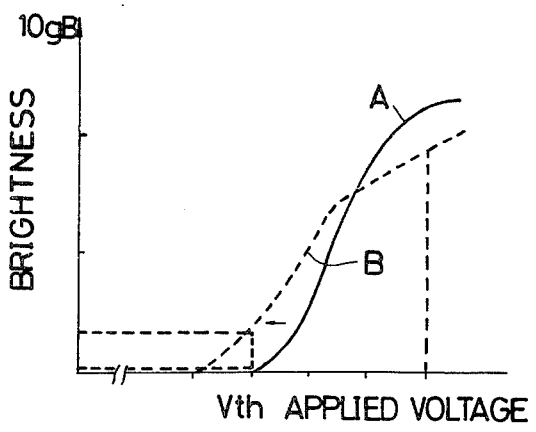
FIG. 1 is a graph for explaining voltage vs. brightness characteristics between a burned pixel and a non-burned pixel.

(1) Comparison of voltage vs. brightness characteristics between abnormal pixels suffering from the burning phenomenon and normal ones is illustrated in FIG. 1. The curve A shows a non-burned pixel and the curve B shows a burned pixel. It is clear from FIG. 1 that the burning phenomenon is one where brightness increases within a firing voltage region with the passage of time and decreases within a high brightness region.

(2) The burning phenomenon appears gradually from the bottom and top of a display area with the passage of time while displaying a fixed display pattern. In other words, the burning phenomenon is amplified as the phase of the write pulse $V_W$ shifts toward that of the refresh pulse.

(3) The greater the degree of the burning phenomenon affecting the pixels, the greater is the difference between the amplitude of polarization occurring after application of the refresh pulse and that occurring after application of the write pulse, so that the amplitude of polarization is greater of an upper portion of the display area than at a lower portion after application of the refresh pulse and the amplitude of polarization is greater at the lower portion that at the upper after application of the write pulse.

Figure 2:
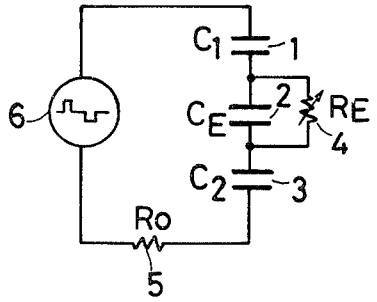
FIG. 2 is an equivalent circuit diagram of a thin-film EL display panel.

Based upon the foregoing findings, the burning phenomenon is believed to take place for the following reasons, as best shown in FIG. 2 which shows an equivalent circuit of the thin-film three-layered structure EL panel.

Figure 3:
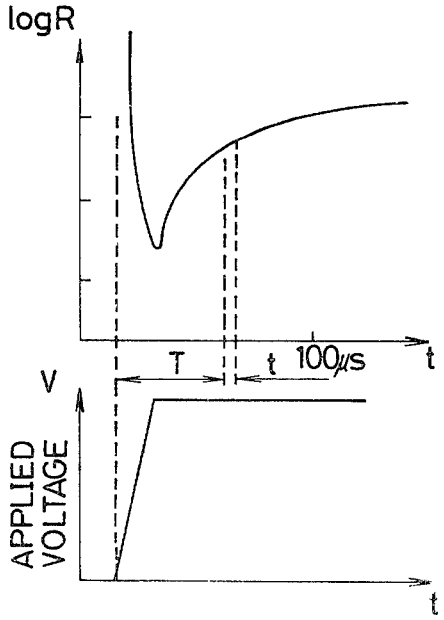
FIG. 3 is a graph for explaining timewise variations in $R_E$.

In FIG. 2, there is illustrated in an equivalent circuit view a layer 1 of dielectric material such as $Y_2O_3$ with a capacitance $C_1$, a layer 2(or 3) of ZnS having capacitance $C_E$ and a resistance $R_E$, doped with a proper activator such as Mn, a layer 4 of dielectric material such as $Y_2O_3$ with a capacitance $C_2$, and one or more transparent electrode such as $In_2O_3$ with a resistance $R_o$. There is further illustrated an external AC pulse source 6. It is noted that, when the voltage across CE in FIG. 2 showing the equivalent circuit of the three-layered structure EL panel reaches a firing voltage, $R_E$ abruptly drops as seen from its time-wise variations in FIG. 3.

To illustrate the reason why the burning phenomenon takes place, assume now that the refresh pulse $V_R$ and the write pulse $V_W$ are correlated in such a phase relationship that the latter $V_W$ is applied in a relatively short period of time after application of the former $V_R$ throughout the panel.

The above-mentioned drop in the value of $R_E$ results in generation of the burning phenomenon. The resistance $R_E$ physically means flow of electrons activated with the firing voltage. The burning phenomenon takes places since the voltage vs. brightness characteristics are changed in case where (1) the width of each of the write pulse and the refresh pulse is shorter than the time width while the change of the resistance $R_E$ is finished, (2) unbalance or asymmetry is present of the peak value, the pulse width and the rising time etc. of each of the write pulse and the refresh pulse, and (3) there is a deviation in between the refresh pulse and the write pulse.

The thin-film EL display panel is a case where a voltage lower than the firing voltage is applied can be estimated to be a condenser. After either of the write pulse and the refresh pulse is applied for a period referred to as T in FIG. 3, the compensation pulse having a polarity opposite to that of each of the write pulse and the refresh pulse and a peak value smaller than that of the firing voltage is applied for a period referred to as t in FIG. 3, according to the present invention. Thus, the value of the resistance $R_E$ can be fixed by measuring damping curves as to the peak value of the compensation pulse. A preferable compensation pulse can be defined and applied according to the present invention.

For convenience of description, the write pulse and the refresh pulse are applied in a short interval. A preferable compensation pulse is also applied.

Figure 4:
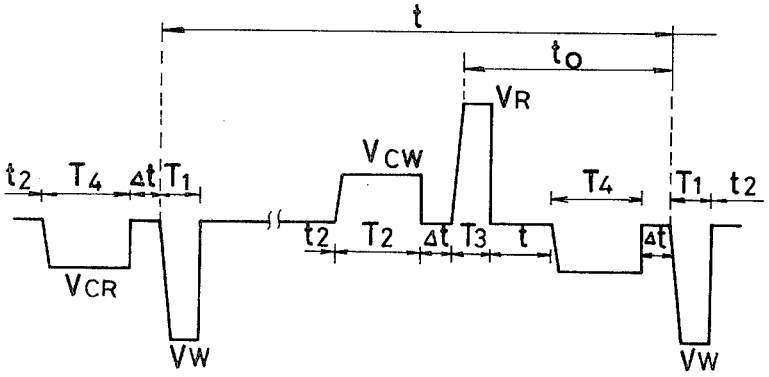
FIG. 4 is a timing chart containing a compensation pulse according to the present invention.

FIG. 4 shows a timing chart for applying a compensation pulse according to the present invention. In FIG. 4, t indicates a cycle having a duration related to $t_o$ as $t=10t_o$. The write pulse is denoted as $V_W$ and the refresh pulse is denoted as $V_R$. Peak values of the write pulse and the refresh pulse are identical. A write compensation pulse is denoted as $V_{CW}$ and a refresh compensation pulse is denoted as $V_{CR}$. The peak values of the write compensation pulse and the refresh compensation pulse are also identical. $T_1$ to $T_4$ indicate each pulse width.

Figure 5:
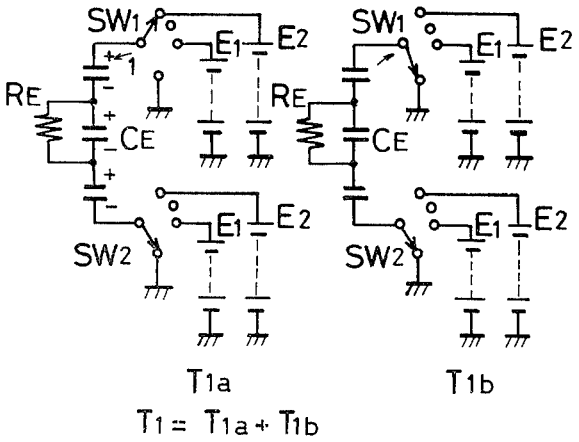
FIGS. 5(A) through 5(D) are a description of a case where the pulse train as shown in FIG. 4 is applied to the thin-film EL display panel.
Figure 5B:
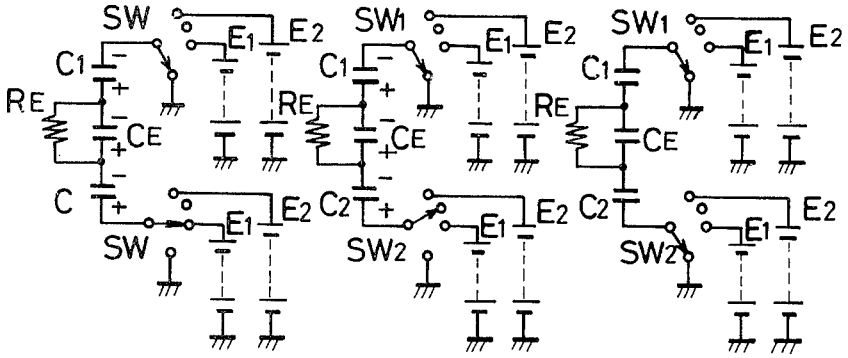
Figure 5C:
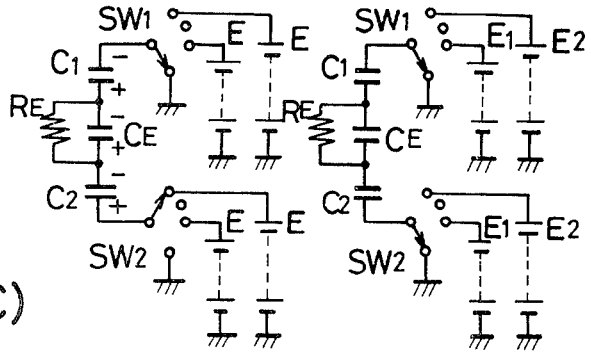
Figure 5D:
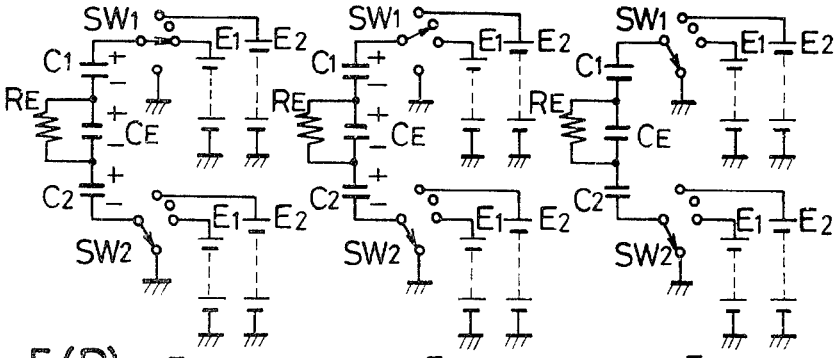

FIGS. 5(A) through 5(D) are a description of a case where the pulse train as indicated in FIG. 4 is applied to the thin-film EL display panel. FIGS. 5(A) through 5(B) indicate a driving method in terms of an equivalent circuit and activation of switches. As shown in these drawings, $V_W$ and $V_R$ are divided to Tia and Tib (i=1, 3) so as to satisfy Ti≃Tia (i=1, 3). $V_{CW}$ and $V_{CR}$ are divided to Tja, Tjb and Tjc (j=2,4) so as to satisfy Tj≃Tjc (j=2,4).

Figure 6:
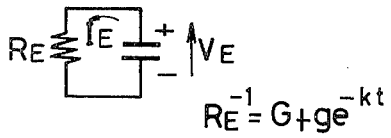
FIGS. 6 and 7 are an equivalent circuit diagram of the thin-film EL display panel.

Although FIGS. 5(A) through 5(D) show as if the peak value of the compensation pulse is varied with $R_E$ at Tjc (j=2,4), it is actual that a leak resistance in the driving circuit, $C_1$ and $C_2$ vary the peak value or a measuring instrument vary the peak value. But, these factors can be neglected. Therefore, the variation in the peak value of the compensation pulse at the period Tjc (j=2,4) can be estimated to indicate the variation in a bias voltage to $C_E$. The bias voltage to $C_1$ and $C_2$ can be estimated to be constant. Therefore, in the circuit essentially consisting of $C_E$ and $R_E$ as shown in FIG. 6, the variation in the peak value of the compensation pulse can be obtained by calculating the bias voltage to $C_E$.

Assuming that an initial voltage applied to this circuit is $V_o$, a bias voltage $V_E$ to $C_E$ can be calculated with the following equation (1).

$$C_E R_E \frac{dV_E}{dt} + V_E = 0 \tag{1}$$

With reference to FIG. 2, $R_E$ is assumed to be represented with equation (2). A time t is counted assuming that an initial application time of the compensation pulse is zero.

$$(R_E)^{-1} = G + ge^{-kt} \tag{2}$$

where G, g and k are a constant.

Then, equation (3) is calculated using equations (1) and (2).

$$\frac{1}{V_E} dV_E = -\frac{1}{C_E R_E} dt$$

$$= -\frac{G + ge^{-kt}}{C_E} dt$$

$$\therefore V_E = Ae^{-\alpha t} e^{\beta e - kt},\ \alpha = G/C_E\ \beta = gk/C_E$$

Initial condition: $V_E = V_0$ (t=0)

$$V_E = V_0 e^{-\beta} e^{-\alpha t} e^{\beta e - kt} \tag{3}$$

$$\alpha = G/C_E \tag{4}$$

$$\beta = gk/C_E \tag{5}$$

Assuming that the bias voltage to $C_1$ and $C_2$ is $V_1$ and $V_2$, a bias voltage $V_{EL}$ to the thin-film EL display panel is represented with equation (6).

$$V_{EL} = V_1 + V_2 + V_0 e^{-\beta} e^{-\alpha t} e^{\beta e - Kt} \tag{6}$$

Figure 7:
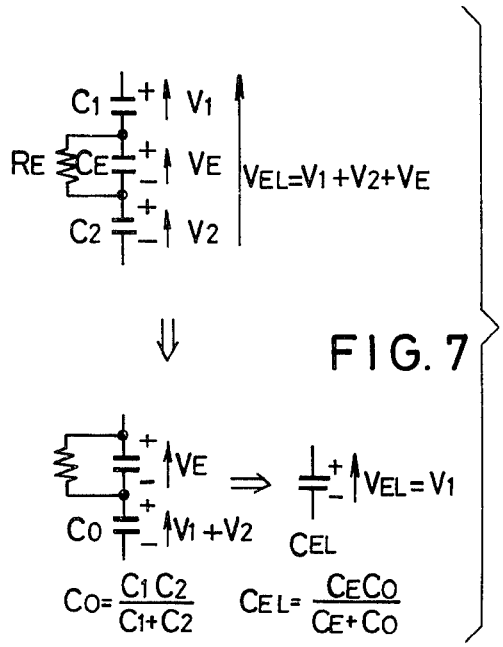

The capacity of $C_1$ and $C_2$ is calculated using the dielectric constant and the thickness of the dielectric layer involved. An initial voltage $V_I$ of $V_{EL}$ and the capacity of the thin-film EL display panel can be measured. Then, $V_0$ and $C_E$ are calculated. Equation (9) indicates the results. FIG. 7 shows an explanation of equation (9).

$$C_{EL} = \left(\frac{1}{C_1} + \frac{1}{C_2} + \frac{1}{C_E}\right)^{-1} \tag{7}$$

$$C_0 = \left(\frac{1}{C_1} + \frac{1}{C_2}\right)^{-1} \tag{8}$$

-continued $$\left.\begin{aligned} \therefore V_0 = V_I \cdot \frac{C_0}{C_{EL}},\ V_1 + V_2 = V_I - V_0 \\ C_E = \frac{C_0 C_{EL}}{C_0 - C_{EL}} \end{aligned}\right\} \quad (9)$$

The variation in the peak value of the compensation pulse measured corresponds to $V_{EL}$ in equation (6). Therefore, $V_0$ is obtained using equations (6) to (9) with experimental results. $\alpha$, $\beta$ and k are fixed.

Figure 8:
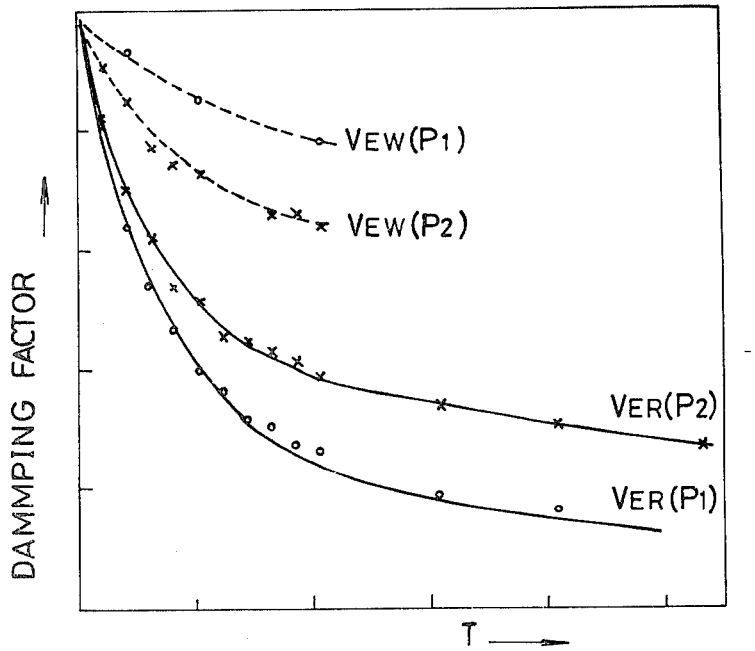
FIG. 8 is a graph for explaining a damping curve of a peak value of the compensation pulse.

FIG. 8 shows the experimental results and damping curves obtained with equation (6). Calculated values are plotted in an actual line and a dotted line in terms of equation (6). O and X are the experimental results. $V_{EW}(P_1)$ and $V_{EW}(P_2)$ indicate the write compensation pulse. $V_{ER}(P_1)$ and $V_{ER}(P_2)$ indicate the refresh compensation pulse. $P_1$ and $P_2$ represent a method for applying either of the write pulse and the refresh pulse to the thin-film EL display panel, i.e., a polarity of the EL display panel.

FIG. 8 indicates that the experimental results agree to the calculated results by equation (6). It is also demonstrated that the assumption and the approximation with regard to equations (1) and (2) are reasonable.

$\alpha$, $\beta$ and k in equations (4) and (5) are obtained with the experimental results using parameters of the size S of the illumination region in the thin-film EL display panel, the peak value V of the compensation pulse and the polarity $P_0$ of the thin-film EL display panel. After it is demonstrated that the experimental results agree to the calculated results as shown in FIG. 8, $\alpha$, $\beta$ and k are fixed as summarized below.

(A) The variation in $\alpha$, $\beta$ and k depending on the peak value V by making S and P constant:

$\alpha$ and k are constant. $\beta$ is inversely proportional to V. That is, $\beta(V_1)<\beta(V_2)$ in $V_1>V_2$.

(B) The variation in $\alpha$, $\beta$ and k depending on the size S by making V and P constant:

$\alpha$ and k are constant. $\beta$ is inversely proportional to S. That is, $\beta(S_1)<\beta(S_2)$ in $S_1>S_2$.

(C) The variation in $\alpha$, $\beta$ and k depending on the polarity $P_0$ by making V and S constant:

$\alpha$ and k are constant $$\beta(P_1)<\beta(P_2)$$

When the burning phenomenon is considered to be an electrical phenomenon, the variation in the peak value of the compensation pulse can be used to analyze the burning phenomenon. The variation in the peak value and the values of $\alpha$, $\beta$ and k are referred to in equation (3) and (A) to (C). In equation (3), term $e^{-\alpha t}$ can be generated by considering the thin-film EL display panel to be a loss resistor (1/G) and term $e^{-\beta}e^{\beta e^{-kt}}$ can be generated by considering $R_E$ to be represented by equation (2) because $\alpha$ is constant in (A) to (C). Then, the burning phenomenon corresponds to term $e^{-\beta}e^{\beta e^{-kt}}$.

Therefore, when the parameters S, V and $P_0$ are made constant, the width of the compensation pulse should be fixed so as to make $e^{-\beta}e^{\beta e^{-kt}}$ sufficiently small. Because $e^{-\beta}e^{\beta e^{-kt}} \rightarrow e^{-\beta}$ in $t \rightarrow \infty$, the condition of the compensation pulse for reducing the burning phenomenon is $e^{-\beta}e^{\beta e^{-kt}} \leqq Ke^{-\beta}$ (K: constant). The value of K should be determined depending on the condition of the burning phenomenon. As K nears 1, the requirement of the compensation pulse becomes severe. The above requirement of the compensation pulse is formulated in equation (10).

$$e^{-\beta}\, e^{+\beta e^{-kt}} \leqq Ke^{-\beta}$$

$$\therefore e^{\beta e^{-kt}} \leqq K \quad (K\text{: constant})$$

$$\therefore t \geqq -\left(\frac{1}{R}\right) \ln\left[\frac{1}{\beta} \ln K\right] \quad (10)$$

The write compensation pulse and the refresh compensation pulse must be balanced. A requirement for the balance can be obtained from equation (2). $\beta$ is represented as $\beta(w)$ concerning the write compensation pulse. $\beta$ is represented as $\beta(R)$ concerning the refresh compensation pulse.

$$\text{Assuming } (R_{EW})^{-1} = G_W + g_w e^{-ktw}, (R_{ER})^{-1} = G_R + g_R e^{-ktR}$$

$$\text{Requirement: } R_{ER} = R_{EW}$$

Since $\alpha$ and k are constant when V,S and $P_o$ are varied, G is also constant so that $\beta \propto g$. The requirement for balancing the two kinds of compensation pulses is represented by equation (11).

$$G = G_W = G_R \quad (11)$$

$$k = k_W = k_R$$

$$(R_{EW})^{-1} - (R_{ER})^{-1} = g_W e^{-ktw} - g_R e^{-ktR} = 0$$

$$\therefore g_W e^{-ktw} = g_R e^{-ktR}$$

$$\therefore l_n g_w e^{-ktw} = l_n g_R e^{-kt_r}$$

$$\therefore \Delta t = t_R - t_W = 1/k \ln g^R/g^W$$

$$\Delta t = t_R - t_W = (1/k)\ln[\beta(R)/\beta(W)]$$

Requirement for the compensation pulse width:

$$t \geqq -\frac{1}{k} \ln\left[\frac{1}{\beta} \ln K\right] \quad (10)$$

$$\Delta t = t_R - t_W = (1/k)\ln\,[\beta(R)/\beta(W)] \quad (11)$$

Based on the states as shown in FIGS. 5(A) to 5(D), the phases of the refresh pulse and the write pulse are made constant to calculate equation (11). Further, a parameter of a phase Ph can be added to thereby establish equations (10) and (11).

In conclusion, when the compensation pulse is applied to the thin-film EL display panel, the resistor $R_E$ in the equivalent circuit of FIG. 2 can be represented by equation (2). The bias voltage $V_E$ to $C_E$ leads to equations (1) to (6) with reference to FIG. 6. The burning phenomenon results from term $e^{-\beta}e^{\beta e^{-kt}}$ in equations (2) and (3). Then, the requirement for the compensation pulse width is obtained as indicated in equations (10) and (11). The value of each of $\alpha$, $\beta$ and k can be fixed based on the experimental results and equations (3) and (6) using the parameters S, V, $P_o$ and $P_h$.

In addition to the application of a preferable compensation pulse to the thin-film EL display panel, the above driving techniques can be used to evaluate and consider the relative severity of the burning phenomenon.

FIG. 10 shows a specific example of a timing chart including the compensation pulse according to the present invention. In FIG. 10, each factor is valued as follows:

The peak value of the write pulse $V_W$:
The peak value of the refresh pulse $V_R$:
The width of the write pulse $t_w$:
The width of the refresh pulse $t_R$:

$$V_W = V_R = 230V$$

$$t_w = t_R = 40\mu \text{ sec}$$

The peak value of the write compensation pulse $V_{CR}$:
The peak value of the refresh compensation pulse $V_{CW}$:
The width of the write compensation pulse $t_{CR}$:
The width of the refresh compensation pulse $t_{CW}$:

$$V_{CW} = V_{CR} = 90V$$

$t_{CW}$ and $t_{CR}$ are parameters.

Table I shows data with the parameters $t_{CW}$ and tCR.

TABLE I

| | $t_{CW}$ | $t_{CR}$ |
|---|---|---|
| ○ | 600μ Sec | 600μ Sec |
| △ | 600μ Sec | 300μ Sec |
| □ | 600μ Sec | 100μ Sec |
| • | 100μ Sec | 600μ Sec |
| ▮ | 100μ Sec | 300μ Sec |
| ■ | 100μ Sec | 100μ Sec |

A cycle T was 8.3 msec. The phase difference between the write pulse and the refresh pulse was T/10. α, β and k of the thin-film EL display panel were as follows:

$$\alpha \simeq 16\ (\text{Sec}^{-1})\ \beta(W) \simeq 0.08,\ \beta(R) \simeq 0.15,\ k \simeq 3 \times 10^3 (\text{Sec}^{-1})$$

Therefore, the width of the compensation pulse was calculated using equations (10) and (11) when K=1.07.

$$t_{CW} \geqq \frac{1}{k}\left|\ln\left[\frac{1}{\beta(W)}\ln(1.07)\right]\right. = \frac{1}{3.3 \times 10^3}\left|\ln\left[\frac{1}{0.08}\ln(1.07)\right]\right. \approx 5.5 \times 10^{-6}(\text{Sec}) \quad (12)$$

$$\therefore t_{CW} \geqq 55\mu \text{ Sec}$$

$$t_{CR} \geqq \frac{1}{k}\left|\ln\left[\frac{1}{\beta(R)}\ln(1.07)\right]\right. = \frac{1}{3.3 \times 10^3}\left|\ln\left[\frac{1}{0.15}\ln(1.07)\right]\right. \approx 2.7 \times 10^{-4}(\text{Sec}) \quad (13)$$

$$\therefore t_{CR} \geqq 270\mu \text{ Sec}$$

$$\Delta t = t_{CR} - t_{CW} = \frac{1}{k}[\ln\beta(R) - \ln\beta(W)] \quad (14)$$

$$= \frac{1}{3 \times 10^3}[\ln(0.08)]$$

-continued $$= 210\mu \text{ Sec}$$

From equations (12) to (14), $t_{CR}$=300 μsec is fixed to satisfy equations (19) and (11). A preferable pulse width is calculated as follows:

$$t_{CW} = 90\mu \text{ Sec}$$

$$t_{CR} = 300\mu \text{ Sec}$$

Figure 9A:
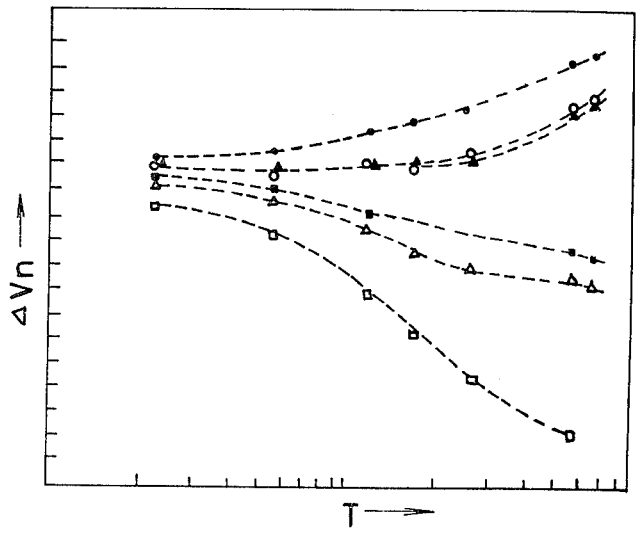
FIGS. 9(A) and 9(B) are a graph for explaining the effect of the compensation pulse applied according to the present invention.
Figure 9B:
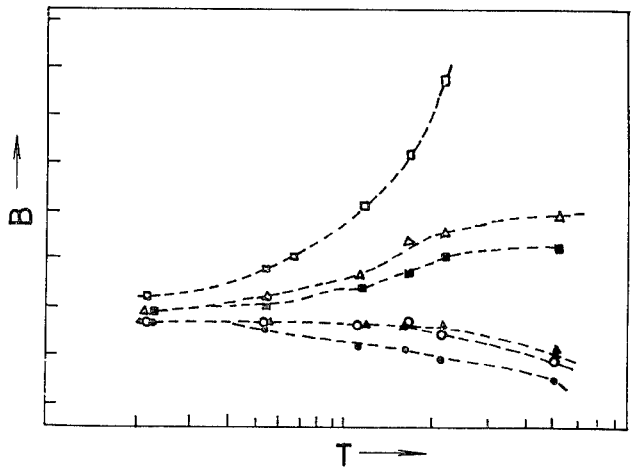

FIGS. 9(A) and 9(B) are a graph for explaining the effect of the compensation pulse applied. The abscissa of FIG. 9(A) is an aging time T and the ordinate there of is a deviation $\Delta V_{th}$ from a firing threshold voltage $V_{th}$. In FIG. 9(B), the abscissa is an aging time T and the ordinate is a brightness B at the firing threshold voltage $V_{th}$.

As is evident from FIGS. 9(A) and 9(B), the deviation $\Delta V_{th}$ and the brightness B are minimized when $t_{CW}$=100 μsec and $t_{CR}$=300 μsec. Thus, the burning phenomenon is remarkably reduced in agreement with the calculated results in equation (15).

It is evident from FIGS.9(A) and 9(B) that the remaining combinations such as Δ and □ in Table I can not reduce the burning phenomenon.

The application method and the driving method in this example shown in FIG. 10 are identical with those of FIGS. 5(A) to 5(D).

Thus, the application of the compensation pulse in this manner assures a reduction in the burning phenomenon and enhances the visibility of the display for a long period. This application technique of the compensation pulse is effective for the burning phenomenon owing to the unbalance in (1) the peak values of the write pulse and the refresh pulse (2) the pulse width thereof (3) the rising time thereof and the polarity of the thin-film EL display panel, in addition to the phase difference between the write pulse and the refresh pulse. However, because of the requirement in obtaining equations (2) and (3), the peak value of the compensation pulse must be less than the firing threshold voltage for the thin-film EL display panel.

In place of the above described thin-film EL display panel, the present invention can be adapted for a two-layer EL display panel comprising an EL layer and a dielectric layer, and a three-layer EL display panel comprising an EL layer-a dielectric layer-an EL layer, in particular, a memory type EL display panel thereof.

As a further application of the present invention, a constant current circuit is provided for charging the thin-film EL display panel for a predetermined period through data electrodes or scanning electrodes. The constant current circuit comprises a constant current source and switch means. After a charged voltage is kept in the EL display panel for a predetermined time, the charged voltage is discharged from switch means provided between the scanning electrodes and the data electrodes.

More particularly, when a condenser having a capacity of C is charged for a time T with a constant current I, a bias voltage $V_C$ to the condenser is represented by equation (2-1).

$$Q = \int_0^T I\,dt = T \cdot I,\ Q = CV_C \quad \text{.....(2-1)}$$

-continued $$\therefore V_C = TI/C$$

As stated above, the EL display panel during the application of the compensation pulse can be treated as a condenser. When the capacitor of the EL display panel is represented as follows:

$$V_{EL} = \frac{TI}{C_{EL}} \quad \text{.....(2-2)}$$

FIGS. 11(A) to 11(E) are a description of a case where the compensation pulse is applied with the constant current circuit. In FIGS. 11(A) to 11(E), a constant current source is denoted as A, switches are denoted as $SW_1$ and $SW_2$, the capacitance of the EL display panel is denoted as $C_{EL}$, the bias voltage to the EL display panel is denoted as $V_{EL}$, a time is indicated as T, and a constant current of the constant current source is denoted as I.

FIG. 11(A): $V_{EL}=0$ $SW_1$ and $SW_2$ are both off.

FIG. 11(B): After $T_1$ lapses, $SW_2$ is kept off but $SW_1$ is on so that $V_{EL}=V_O$ by charging the EL display panel with I for $T_2$. ($V_O=(TI/C_{EL})$)

FIG. 11(C): $SW_1$ and $SW_2$ are off for $T_3$ so as to maintain $V_O$ to the EL display panel.

FIG. 11(D): $SW_1$ is off and $SW_2$ is on at $T_4$ to discharge $V_O$ in the EL display panel.

FIG. 11(E) shows a change in the bias voltage to the EL display panel obtained through the driving as indicated in FIGS. 11(A) to 11(D). Thus, the compensation pulse having a pulse width $T_3$ and a peak value $V_O$ is applied to the EL display panel.

Although FIGS. 11(A) to 11(D) show an example in which the compensation pulse is applied through either of the data electrodes and the scanning electrodes by using the constant current source, it is possible to apply the compensation pulse through both of the data electrodes and the scanning electrodes as shown in FIGS. 5(A) to 5(D) with the timing chart of FIG. 4. This purpose can be carried out by replacing the power source $E_1$ in FIGS. 5(A) to 5(D) with the constant current source A in FIGS. 11(A) to 11(D).

It will be apparent from the above example shown in FIGS. 11(A) to 11(D) and equation (2-1) that the bias voltage can be freely controlled depending on the charging time T. Therefore, the peak value of the compensation pulse can be varied so as to simplify a configuration of the driving circuit.

Figure 12:
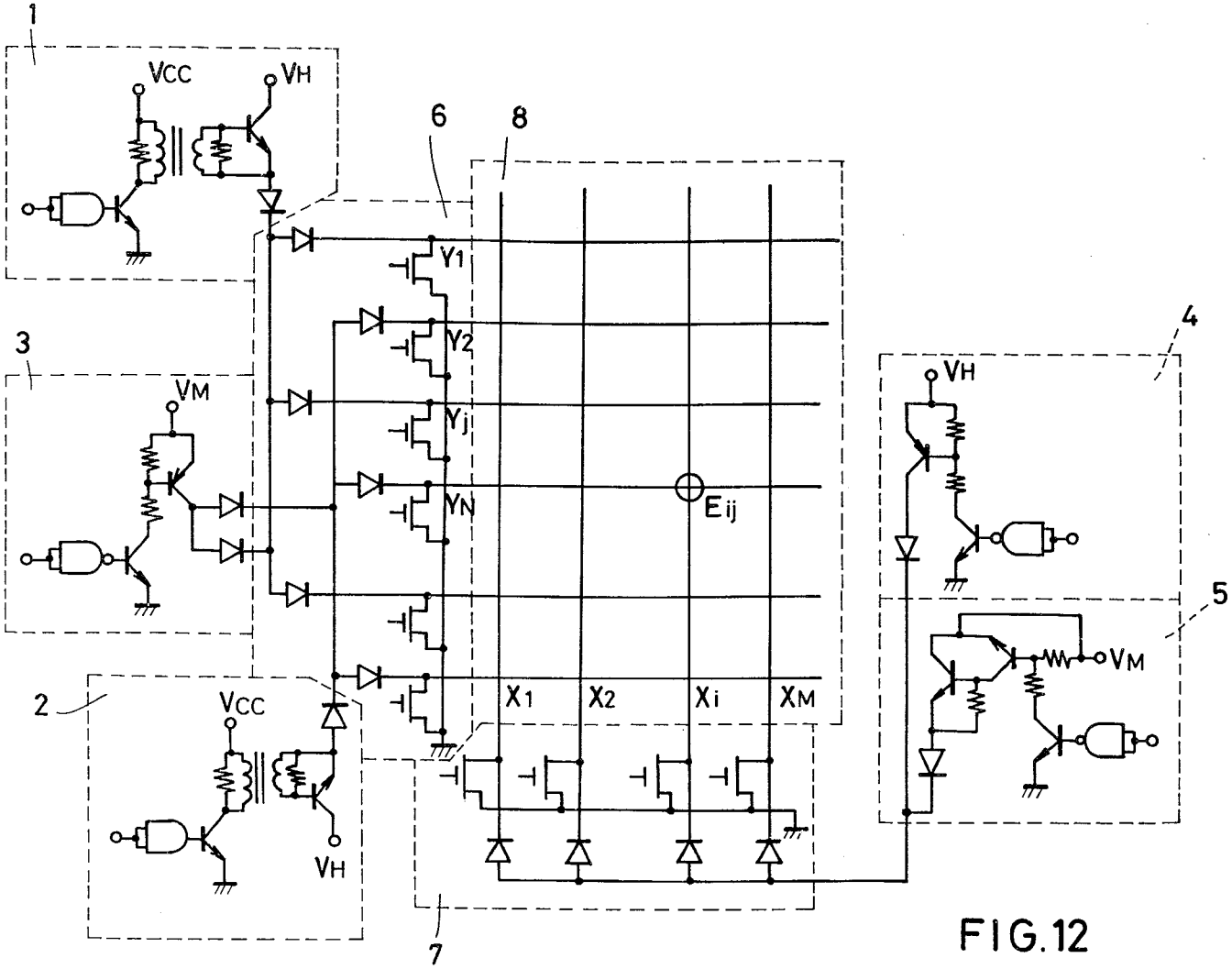
FIG. 12 is a driving circuit for driving the thin-film EL display panel according to the present invention.

FIG. 12 shows a specific example of circuitry according to the present invention. The write pulse $V_W$ is applied for a line-at-a time operation. After a single frame is completed, the refresh pulse voltage $V_R$ having a polarity opposite to that of the write pulse is applied over the total display panel. The refresh pulse and the write compensation pulse $V_{CR}$ having a polarity opposite to that of the refresh pulse and a voltage lower than the firing threshold voltage are applied over the total display panel after completion of a single frame. Thereafter, the refresh compensation pulse $V_{CR}$ having a polarity identical with that of the refresh pulse and a voltage lower than the firing threshold voltage is applied to the picture elements in the total display panel.

In FIG. 12, 1 indicates a refresh pulse driving circuit, 2 indicates a write compensation pulse driving circuit, 3 and 4 are a pre-charge circuit, 5 indicates a refresh compensation driving circuit, 6 indicates a scanning-side switching circuit, 7 indicates a data-side switching circuit, 8 indicates the thin-film EL display panel and $E_{ij}$ indicates a picture element positioned at (i, j).

The constant current switch circuit is provided by using constant current characteristics of transistor means as shown in FIGS. 13(A) to 13(C).

The transistor means shows the constant current characteristics by selecting an appropriate base current as shown in FIG. 13(A). Selection of $I_B$ in an appropriate value in the driving circuit of FIG. 13(B) provides the constant current characteristics. As FIG. 13(C) shows, the bias voltage to $C_{EL}$ can be set in any desired value up to an input voltage $V_H$ with pulse width T. When $I_B=0$, the transistor is biased off. The constant current switch circuit is provided with the driving circuit of FIG. 13(B). The bias voltage to $C_{EL}$ can be set as shown in FIG. 13(C).

The transistor means operates the switch $SW_2$ and the constant current source A in FIGS. 11(A) to 11(D). Each of the driving circuits 1, 2 and 5 in FIG. 12 corresponds to the constant current switch circuit. The discharging switch $SW_2$ in FIGS. 11(A) to 11(D) corresponds to the switches 6 and 7 in FIG. 12.

With the help of the driving circuits 1 and 2, the write pulse $V_W$ is applied to the scanning electrodes $Y_{ij}$ in the EL display panel in the line-at-a time operation. All the data-side switch circuits 7 are turned off after completion of the scanning operation in a single frame. The switch circuits 1 and 2 are operated for an appropriate time to keep a constant voltage in the EL display panel. Discharging is enabled by turning the switch circuits 6 and 7 on. Then, the refresh compensation pulse $V_{CW}$ is applied to the EL display panel.

After the refresh pulse is applied with the driving circuits 1 and 2, all the scanning-side switch circuits 6 are turned on to operate the constant current switch circuit 5 for a predetermined time. After the EL display panel develops a constant voltage, all the switch circuits 6 and 7 are on to discharge the voltage. The refresh compensation pulse $V_{CR}$ is applied to the EL display panel.

According to the present driving technique, the width and the peak value of the compensation pulse can be easily set. The refresh driving circuit and the write driving circuit function also as the compensation pulse driving circuit to thereby simplify the circuit configuration.

It is obvious that the present invention is equally applicable to any capacity type display such as a plasma display panel, in addition to the EL display panel.

While only a certain embodiment of the present invention has been described, it will be apparent to those skilled in the art that various changes and modifications may be made therein without departing from the spirit and scope of the invention as claimed.

What is claimed is:

1. A display device comprising:

an El panel including an electroluminescent layer, an array of scan electrodes, an array of data electrodes crossing the scan electrodes and a plurality of pixels each lying sandwiched between a respective one of the scan electrodes and a respective one of the data electrodes;

means for sequentially applying a write pulse voltage to the scan electrodes in a line scanning fashion;

means for applying a refresh pulse voltage of a polarity opposite said write pulse voltage to the entire said panel upon completion of each single scan by said means for applying a write voltage pulse;

means for applying to the entire said panel upon each application of a said write pulse to all said pixels a write compensation pulse of the same polarity as said refresh pulse voltage and of an amplitude insufficient to cause electroluminescence, and for applying a refresh compensation pulse of a polarity opposite to said refresh pulse voltage and of an amplitude insufficient to cause electroluminescence;

the durations of said write compensation pulse and said refresh compensation pulse having a difference (Δt) defined by:

$$\Delta t=(1/k)\ \ln\ [\beta(R)/\beta(W)]$$

where k is a constant, and $$\beta=g^k/C_E$$

where g and k are constants and $C_E$ is the capacitance of the electroluminescent layer, $\beta$[R] and $\beta$(W) being the values of $\beta$ for the refresh and write pulses respectively.

2. A display device comprising:

an EL panel including an array of scan electrodes, an array of data electrodes crossing the scan electrodes and a plurality of pixels each lying sandwiched between a respective one of the scan electrodes and a respective one of data electrodes;

means for sequentially applying a write pulse voltage to the scan electrodes in a line scanning fashion;

means for applying a refresh pulse voltage of a polarity opposite said write pulse voltage to the entire said panel upon completion of each single scan by said means for applying a write voltage pulse;

means for applying to the entire said panel, upon each application of a said write pulse to all said pixels, a write compensation pulse of the same polarity as said refresh pulse voltage and of an amplitude insufficient to cause electroluminescence, and for applying a refresh compensation pulse of a polarity opposite to said refresh pulse voltage and of an amplitude insufficient to cause electroluminescence;

constant current means responsive to said means for applying the write voltage pulses, refresh voltage pulse, write compensation pulse and refresh compensation pulse for applying a charge voltage to the EL panel through the scan electrodes and the data electrodes; and switch means provided between the scan electrodes and the data electrodes for discharging said charge voltage from said EL panel.

3. A method of driving an electroluminescent (EL) display panel including an electroluminescent layer, an array of data electrodes crossing the scan electrodes and a plurality of pixels each sandwiched between a respective one of the scan electrodes and a respective one of the data electrodes, said method comprising:

sequentially applying write pulses to said scan electrodes in a line scanning fashion;

means for applying a refresh pulse of a polarity opposite that of said write pulses to the entire said panel upon completion of each complete application of said write pulses;

applying to the entire said display panel, upon each application of a said write pulse to all said pixels, a write compensation pulse of the same polarity as said refresh pulse and of an amplitude insufficient to cause electroluminescence, and a refresh compensation pulse of a polarity opposite that of said refresh pulse and of an amplitude insufficient to cause electroluminescence;

the durations of said write compensation pulse and said refresh compensation pulse having a difference (Δt) defined by:

$$\Delta t=(1/k)\ \ln\ [\beta(R)/\beta(W)]$$

where k is a constant, $$\beta=gk/C_E$$

where g and k are constants and $C_E$ is the capacitance of the electroluminescent layer, $\beta$[R] and $\beta$(W) being the values of $\beta$ for the refresh and write pulses respectively.

4. A method of driving an electroluminescent (EL) display panel including an electroluminescent layer, an array of data electrodes crossing the scan electrodes and a plurality of pixels each sandwiched between a respective one of the scan electrodes and a respective one of the data electrodes, said method comprising:

sequentially applying write pulses to said scan electrodes in a line scanning fashion;

applying a refresh pulse of a polarity opposite that of said write pulses to the entire said panel upon completion of each complete application of said write pulses;

applying to the entire said display panel, upon each application of a said write pulse to all said pixels, a write compensation pulse of the same polarity as said refresh pulse and of an amplitude insufficient to cause electroluminescence, and a refresh compensation pulse of a polarity opposite that of said refresh pulse and of an amplitude insufficient to cause electroluminescence;

wherein said steps of applying drive said panel with a constant current when charging a voltage upon said panel; and discharging the charged voltage through switch means provided between the scan electrodes and the data electrodes.

* * * * *